US006634331B2

(12) United States Patent
Truglio

(10) Patent No.: US 6,634,331 B2
(45) Date of Patent: Oct. 21, 2003

(54) PISTON WITH INTEGRATED SPARK ELECTRODE

(76) Inventor: Rosario Truglio, 2305 Acorn La., Ceres, CA (US) 95307

( * ) Notice: Subject to any disclaimer, the term of this patent is extended or adjusted under 35 U.S.C. 154(b) by 0 days.

(21) Appl. No.: 09/905,453

(22) Filed: Jul. 12, 2001

(65) Prior Publication Data

US 2003/0010307 A1 Jan. 16, 2003

(51) Int. Cl.[7] ..... F02P 15/04

(52) U.S. Cl. ..... 123/162; 123/169 EL; 123/169 EA; 123/169 EB; 123/169 EC; 123/169 E

(58) Field of Search ..... 123/193.6, 260, 123/169 EL, 169 EB, 169 E, 162, 287, 309, 169 EC, 169 P, 169 PA

(56) References Cited

U.S. PATENT DOCUMENTS

| | | | | | |
|---|---|---|---|---|---|
| 1,401,231 | A | * | 12/1921 | Anderson | 123/143 R |
| 4,294,206 | A | | 10/1981 | Urlaub et al. | 123/276 |
| 4,436,068 | A | | 3/1984 | Nakamura et al. | 123/310 |
| 4,539,950 | A | | 9/1985 | Schaich | 123/79 |
| 4,815,422 | A | | 3/1989 | Schaich | 123/79 |
| 5,046,466 | A | | 9/1991 | Lipski | 123/310 |
| 5,915,349 | A | * | 6/1999 | Biemelt et al. | 123/162 |
| 6,453,862 | B1 | * | 9/2002 | Holzmann | 123/162 |

FOREIGN PATENT DOCUMENTS

| | | | | |
|---|---|---|---|---|
| DE | 3407951 | * | 7/1985 | F02P/15/04 |
| JP | 126114 | * | 5/1997 | F02P/15/08 |
| JP | 252631 | * | 9/1998 | F02P/15/04 |
| JP | 12337 | * | 1/2001 | F02P/15/04 |
| JP | 82306 | * | 3/2001 | F02P/15/04 |

* cited by examiner

*Primary Examiner*—Hieu T. Vo
*Assistant Examiner*—Hai H. Huynh
(74) *Attorney, Agent, or Firm*—Henneman & Saunders; Larry E. Henneman, Jr.

(57) ABSTRACT

A piston is disclosed, for use in an internal combustion engine, including an insulating guide formed therein for receiving an electrode. The electrode has a body, and at least one spark lead coupled to the body for inserting into a channel formed in the insulating guide. Electrical power is supplied to the electrode by a power plug inserted through a power plug opening in the wall of the combustion chamber of the internal combustion engine. When electric power is supplied to the power plug a first electrical arc is generated between the power plug and the body of the electrode, and a second electrical arc is generated between the tip of each one of the spark leads and an associated arc insert disposed in the piston adjacent the end of the insulating guide. Optionally the electrode is insertable and removable from the piston through the power plug opening.

37 Claims, 6 Drawing Sheets

PISTON WITH INTEGRATED SPARK ELECTRODE

BACKGROUND OF THE INVENTION

1. Field of the Invention

The present invention relates generally to internal combustion engines and more particularly to a piston, having a novel ignition system embodied therein, for spark-igniting an air-fuel mixture within the internal combustion engine.

2. Description of the Background Art

Modem spark ignition engines are designed and constructed to maximize horsepower, torque, and fuel economy, and to at the same time reduce polluting exhaust emissions to a minimum. A lean air-fuel mixture (more air than fuel) is desirous in most cases because it yields increased fuel economy and lowered emissions, but at the cost of lowered horsepower and torque. Horsepower and torque are decreased because of the slow burn rate of the lean mixture. If the burn rate of the lean air-fuel mixture is increased, horsepower and torque are substantially increased as well.

High performance and racing engine applications would also benefit from increased burn rates. Because fuel economy is not a concern in high performance engines a richer air-fuel mixture is used to increase horsepower and torque. These engines, however, typically require high-octane fuels to compensate for higher compression ratios. Conversely, high-octane fuels burn slowly.

There have been two methods previously employed to improve the burn rate of an air-fuel mixture within the combustion chamber of spark-ignition engines. The first method is to add at most a second spark plug to each engine cylinder. Adding a second spark plug does not significantly increase the burn rate because each spark plug is seated in the same wall of the combustion chamber. Therefore, each spark plug produces a spark within close proximity of each other. Thus, the fire must still travel relatively long distances to ignite all of the air-fuel mix. The second method of increasing the burn rate of the air-fuel mixture is to increase the turbulence, or "swirl," of the air and fuel entering the cylinder. This disperses the fuel more uniformly throughout the air and causes a more even, quicker burn. The burn rate of the fuel, however, is still relatively slow because the fire must propagate across the entire combustion chamber. In addition, the amount of swirl that can be introduced is limited because excessive turbulence produces a snuffing effect on the flame.

Most commonly, however, "spark advance" is used to compensate for slow burn times of high-octane and lean fuel mixtures. In particular, sparks are generated 32□ to 38□ of crankshaft rotation before the piston reaches top dead center on its compression stroke. This method is not ideal because energy is lost as the piston is compressing against the expansive force of the ignited air-fuel mixture. By increasing the burn rate of a rich, high-octane or lean air-fuel mixture, less spark advance is required. Thus, the piston would use less energy to compress the expansive, ignited air-fuel mixture, increasing both horsepower and torque.

What is needed is a system that increases the burn rate of an air-fuel mixture within a combustion chamber of an internal combustion engine. What is also needed is a system that generates multiple electrical arcs that are not within close proximity of each other for igniting the air-fuel mixture.

SUMMARY

The present invention overcomes the problems associated with the prior art by providing a novel ignition system that increases the burn rate of a compressed air-fuel mixture within the combustion chamber of an internal combustion engine. A piston with an integrated electrode generates multiple electrical arcs to ignite the compressed air-fuel mixture at spaced apart locations in the combustion chamber.

In one embodiment of the present invention, an internal combustion engine includes at least one piston with an insulating guide formed in the piston for receiving an electrode. Spark to ignite the air-fuel mixture is generated by an electrode disposed within the insulating guide. A power plug disposed in a power plug opening transmits electrical power through the wall of the engine to the electrode.

The electrode, in one particular embodiment, comprises a body and at least one spark lead coupled to the body. When disposed within the insulating guide, a tip of the spark lead is positioned a predetermined distance (spark gap) from a point on the piston near the center of combustion chamber. The body is positioned with respect to the power plug such that providing electrical power to the power plug causes a first electrical arc between the power plug and the body and a second electrical arc between the tip of the spark lead and the piston at a predetermined time of engine operation. Thus, two simultaneous, spaced-apart sparks are provided to ignite the air-fuel mixture in the combustion chamber. Optionally, the piston further includes an arc insert disposed between the tip of the spark lead and the piston, to reduce ablation of the piston surface. The arc insert may comprise a piece of copper fixed to the piston.

In another particular embodiment of the invention, the electrode includes a body and a plurality of spark leads attached to the body. The insulating guide comprises a corresponding plurality of channels, each for receiving one of the plurality of spark leads. The insulating guides are shaped to position the tips of the spark leads within a predetermined distance (spark gap) from arc surfaces of the piston adjacent the end of each insulating guide. The insulating guides may be formed in a channel in the top surface of the piston from a ceramic material. The arc surfaces are spaced apart from one another to increase the burn rate of the air-fuel mixture.

Optionally, the electrode is removable, and can be inserted or removed through the power plug opening. For example, in one particular embodiment the spark leads of the electrode are flexible, and the insulating guide is tapered at a receiving end to facilitate easy insertion of the electrode in the insulating guide. The body of the electrode can be adapted to engage either the insulating guide or the conductive portion of the piston. For example, in one embodiment, the insulating guide includes a seat for receiving the body of the electrode. In this embodiment, the body of the electrode may be formed entirely of conductive material. Alternatively, if the body of the electrode is adapted to engage the piston, then the body includes an insulating portion for engaging the piston and a conductive portion for transmitting electrical power to the spark leads.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art by providing a piston with an insulating spark electrode guide formed therein, thereby facilitating simultaneous, spaced apart sparks that result in quick, efficient ignition of a compressed air-fuel mixture contained within a combustion chamber of an internal combustion engine. In the following description, numerous specific details are set forth (e.g. particular spark location, engine configuration, etc.) in order to provide a thorough understanding of the invention. Those skilled in the art will recognize, however, that the invention may be practiced apart from these specific details. In other instances, well-known details of engine design and operation (e.g. air, fuel, and ignition system operation, mechanical practices, timing, etc.) have been omitted, so as not to unnecessarily obscure the present invention.

Figure 1:
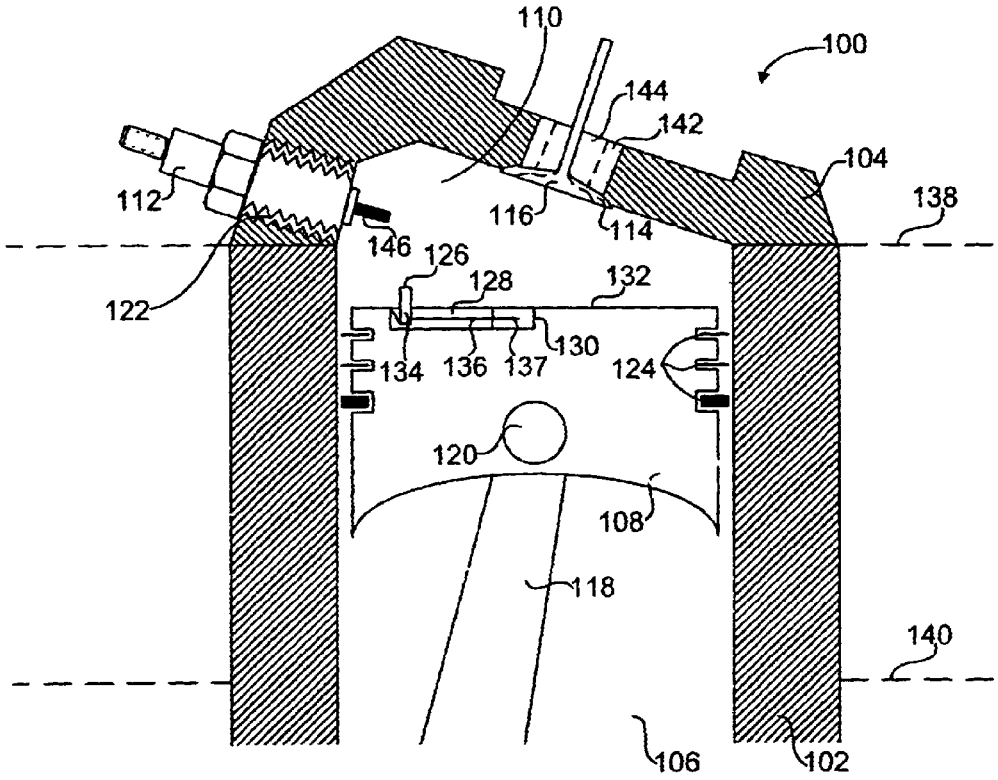
FIG. 1 is a cross-sectional view of an internal combustion engine having a piston in accordance with the present invention.

FIG. 1 shows a cross-sectional view of a portion of an internal combustion engine 100. Internal combustion engine 100 comprises a block 102, a head 104, a cylinder 106, a piston 108, a combustion chamber 110, a power plug 112, an intake valve 114, an exhaust valve 116, and a connecting rod 118. A wrist pin 120 couples piston 108 to connecting rod 118 so that piston 108 can reciprocate within cylinder 106 upon rotation of the crankshaft (not shown). A set of piston rings 124 create an airtight seal between piston 108 and cylinder 106. Certain engine components (e.g. rocker arms, crankshaft, pushrods, etc.) have been omitted from the figure so as not to unnecessarily obscure the invention. Those skilled in the art will recognize that such components are not required to fully understand the functionality of the invention.

Power plug 112 is seated in threaded power plug opening 122, and is thereby removable from head 104 by conventional methods (e.g. ratcheting with a socket wrench). Electrical power is supplied to power plug 112 via a spark plug wire (not shown). In one embodiment, power plug 112 is a conventional spark plug having its ground strap removed.

Piston 108 includes an electrode 126, an insulating guide 128, an arc surface 130, and a piston head 132. Electrode 126 includes a body 134 and a spark lead 136. At least a portion of body 134 of electrode 126 is electrically conductive to transmit electrical power from power plug 112 to spark lead 136. Spark lead 136 has an exposed tip 137 that is disposed a predetermined distance from arc surface 130 of piston 108. Arc surface 130 is a well formed in piston head 132, adjacent the end of insulating guide 128. Arc surface 130 optionally includes a conductive insert (e.g. a piece of copper, platinum, etc.) to prevent ablation of the surface of piston 108. Insulating guide 128 is made of an insulating material (e.g. a ceramic, glass, etc.) and prevents electrode 126 from short circuiting to piston 108 without producing an arc between the tip 137 of spark lead 136 and surface 130.

Internal combustion engine 100 operates on a four-stroke cycle, and therefore will be described in detail as a four-stroke engine. However, those skilled in the art will recognize that the present invention can be used in any internal combustion engine (e.g., two-stroke engines, fuel injected engines, etc.) utilizing spark-ignition combustion.

During operation of engine 100, piston 108 reciprocates within cylinder 106. An intake stroke begins with piston head 132 being located at top dead center (TDC), defined by plane 138. Intake valve 114 opens by methods well known in the art, and piston 108 travels downward within cylinder 106, simultaneously drawing an air-fuel mixture into combustion chamber 110 via an intake port 142. When piston head 132 reaches bottom dead center (BDC), defined by plane 140, intake valve 114 closes for the compression stroke. During the compression stroke, as piston 108 travels back up the cylinder toward TDC, piston 108 compresses the air-fuel mixture in combustion chamber 110.

Near the end of the compression stroke, high voltage is applied to power plug 112 by methods known in the art (e.g. by discharging an ignition coil), creating a voltage drop between the tip 146 of power plug 112 and arc surface 130. Electricity flows from power-plug 112, through electrode 126, to arc surface 130. The flowing electricity generates a first arc between tip 146 of power plug 112 and body 134 of electrode 126, and a second arc between tip 137 of spark lead 136 and arc surface 130. In this particular embodiment, arc surface 130 is located near the center of piston 108. The two electrical arcs (one at each end of electrode 126) ignite the air-fuel mixture in a plurality of locations, causing a faster, more complete combustion within combustion chamber 110. The expansive force of the ignited air-fuel mixture forces piston 108 back down cylinder 106 toward BDC, exerting torque on the crankshaft (not shown). Upon piston 108 reaching BDC, exhaust valve 116 opens, and exhaust gases are forced out of cylinder 106 through exhaust port 144 as piston 108 travels back toward TDC.

Those skilled in the art will realize that the air-fuel mixture is typically ignited before piston 108 reaches TDC on its compression stroke to ensure complete combustion of the compressed air-fuel mixture. As previously stated, modem engines operate at moderate speeds with 32□ to 38□ of spark advance, which ignites the air-fuel mixture quite early, reducing horsepower and torque. By utilizing the present invention, the amount of spark advance can be reduced to approximately 20□ to 25□, thus greatly improving engine performance.

In the embodiment shown, power plug 112 and body 134 are disposed spaced apart from one another when voltage is applied to power plug 112, in order to produce an electrical arc. However, those skilled in the art will recognize that this element (as well as other elements, even if not expressly stated) is not an essential element of the invention. For example, body 134 can be modified to come into electrical contact with power plug 112 in order to transfer current to spark lead 136. Such a modified embodiment would still have the advantage of igniting the air-fuel mixture near the center of combustion chamber 110. Possible modifications to body 134 to facilitate contact between tip 146 of power plug 112 and body 134 of electrode 126 include making body 134 longer and flexible.

It is common in conventional internal combustion engines that the spark plugs used to ignite air-fuel mixtures become corroded. Therefore, it is desirable to be able to replace the spark plugs occasionally. It is expected that the same corrosive process will also affect electrode 126 and power plug 112. In this particular embodiment, power plug 112 is replaceable in the same manner as common spark plugs are replaceable. Further, electrode 126 is removable through power plug opening 122 for replacement without removing head 104 from block 102. An alternate method of removing corrosion from electrode 126 is to apply high frequency, high voltage to the conductive portions of electrode 126 (e.g. body 134 and spark lead 136), which would remove any combustion deposits thereon. Therefore, in an alternate embodiment, electrode 126 can be permanently fixed in insulating guide 128.

Figure 2:
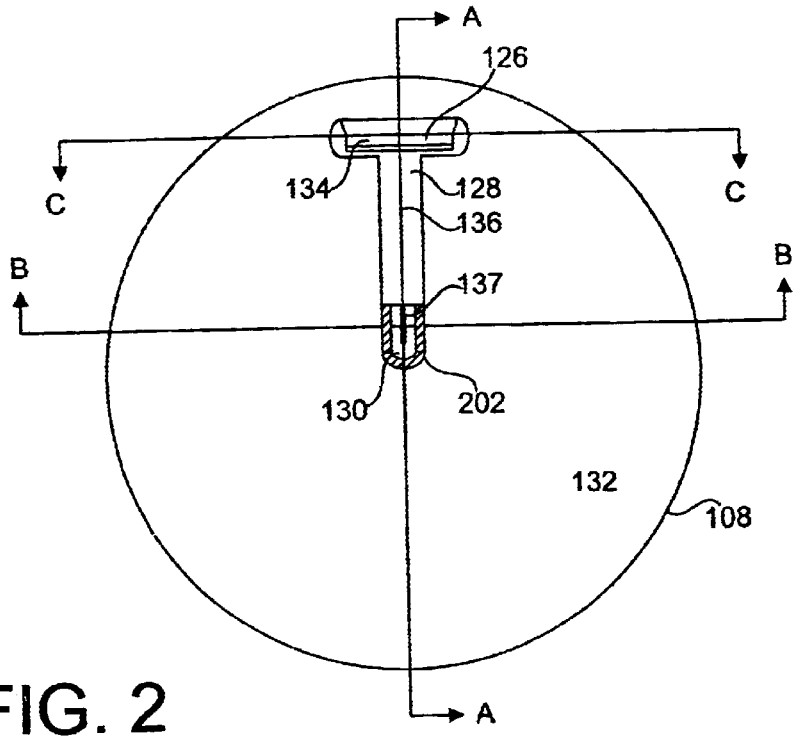
FIG. 2 is a top view of the piston of FIG. 1.

FIG. 2 shows a top view of piston 108. Insulating guide 128 extends from a location near the perimeter to the center of piston 108. Body 134 of electrode 126 is shown seated in insulating guide 128. Spark lead 136 is electrically coupled to body 134 and extends through insulating guide 128 to a point near arc surface 130. Exposed tip 137 of spark lead 136 is positioned a predetermined distance (i.e. the spark gap) away from arc surface 130 by insulating guide 128. As previously described, when electrical power is applied to power plug 112 (not shown) an electrical arc is generated between power plug 112 and body 134 of electrode 126, and a second electrical arc is generated between exposed tip 137 of spark lead 136 and arc surface 130.

In the embodiment shown, arc surface 130 is the inner surface of an arc insert 202 fixed to piston head 132. In this particular embodiment, arc insert 202 is a hemi-cylindrical copper insert. Arc insert 202 prevents deterioration (e.g. corrosion, pitting, etc.) of piston head 108 caused from the electrical arcing.

It should be noted that body 134 does not have to be situated on the perimeter of piston 108, as long as body 134 is within an arcing distance of power plug 112. For example, if power plug 112 were located directly over the center of the piston, body 134 would be located in the center of piston 108, and spark lead 136 would then extend radially outward in a direction away from body 134.

Figure 3:
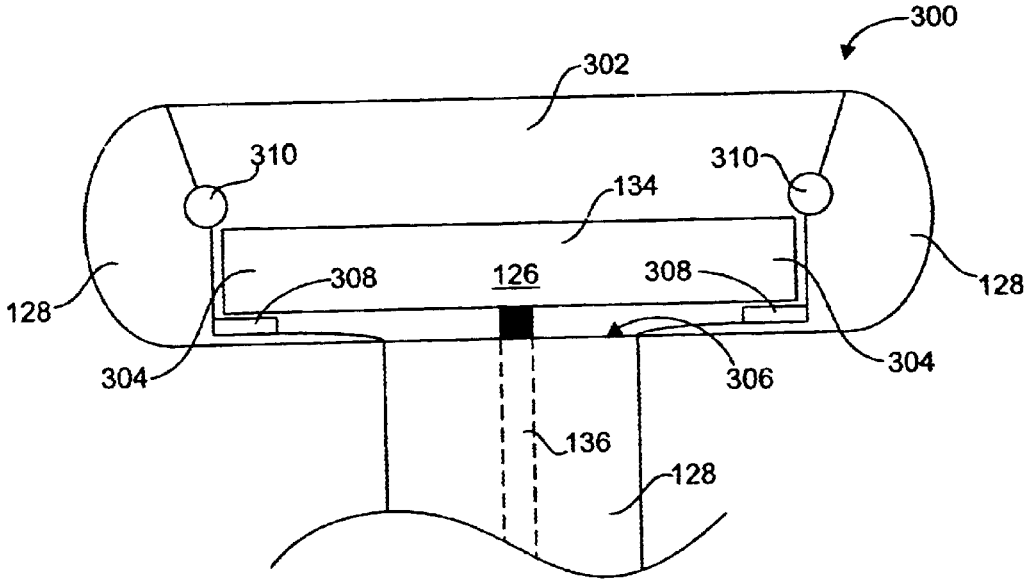
FIG. 3 is an enlarged view of a portion of the insulating guide embodied in the piston of FIG. 2.

FIG. 3 shows an enlarged view of a receiving end 300 of insulating guide 128, that is adapted to receive removable electrode 126. Insulating guide 128 includes a tapered receiving guide 302, a seat 304, a channel 306, positioning surfaces 308, and retaining structures 310. Tapered receiving guide 302 is shaped to easily guide spark lead 136 into channel 306 and body 134 into seat 304. Seat 304 correctly positions body 134 with respect to power plug 112 (not shown), and insulates any conductive portions of body 134 from piston 108. Channel 306 is formed in insulating guide 128, and is tapered to easily receive and guide spark lead 136 as it is inserted. Positioning surfaces 308 abut body 134 of electrode 126 to stop and properly align body 134 in seat 304. Retaining structures 310 retain electrode 126 in proper position when internal combustion engine 100 is operating. In the described embodiment, electrode retainer 310 comprise pimples formed in the vertical wall of tapered receiving guide 302, such that body 134 of electrode 126 can be snapped into and out of seat 304. However, it is contemplated that other types of retaining mechanisms may be substituted for retaining structures 310, with departing from the scope of the invention.

The insertion process of electrode 126 into insulating guide 128 will now be described in detail. First, the crankshaft of engine 100 is rotated until piston 108 is at or near TDC. Electrode 126 is inserted through power plug opening 122 (spark lead 136 first) using forceps that are shaped according to the particular physical features (e.g., diameter of power plug opening 122, etc.) of engine 100. Spark lead 136 is inserted directly through power plug opening 122, with body 134 angled slightly backward. Spark lead 136 is guided into the tapered entrance of channel 306 by tapered receiving guide 302 until body 134 is through power plug opening 122 and butts against positioning surfaces 308. Body 134 is then righted and pushed forward until it snaps past retaining structures 310, completing the insertion process. The particular dimensions of spark lead 136 and body 126 depend on the particular application, to ensure proper spark gaps between power plug 112 and body 134, and spark tip 137 and arc surface 130 (both not shown). Removal of electrode 126 is performed in the reverse of the above-described manner. In particular, electrode 126 is removed by grasping the top of body 134 and pulling, until body 134 snaps out of seat 304 and is drawn out through power plug opening 122.

Figure 4:
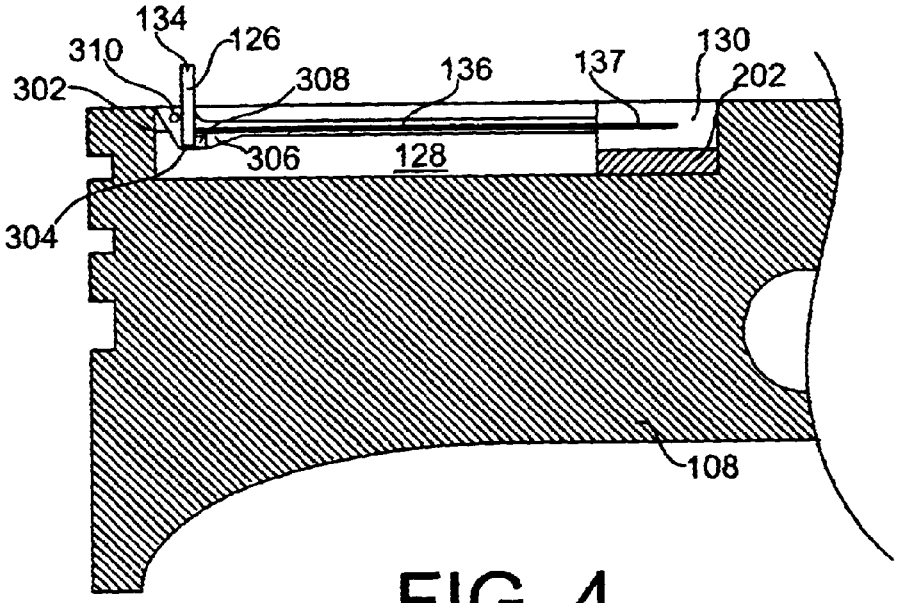
FIG. 4 is a cross-sectional view of the piston of FIG. 2 taken along line A—A.

FIG. 4 is a cross-sectional view of piston 108 taken along section line A—A. Electrode 126 is shown seated in insulating guide 128. Channel 306 is tapered to facilitate easy insertion of spark lead 136 at one and, and to facilitate precise positioning of tip 137 of spark lead 136 with respect to arc surface 130 at the other end. Additionally, it can be seen that tapered receiving guide 302 guides spark lead 136 into channel 306, and guides body 134 into seat 304. Retaining structures 310 and positioning surfaces 308 (only one of each shown) retain body 134 in seat 304. Note that positioning surfaces 308 are disposed only at the lateral edges of channel 306 (see FIG. 3), so as not to interfere with the insertion of spark lead 136.

In this embodiment, spark lead 136 extends from the face of body 134, which ensures proper alignment of spark lead 136 with channel 306 and ease of insertion of electrode 126 into insulating guide 128. However, alternate electrodes may be employed with the present invention, including, but not limited to, electrodes having a unitary body and spark lead structure.

Figure 5:
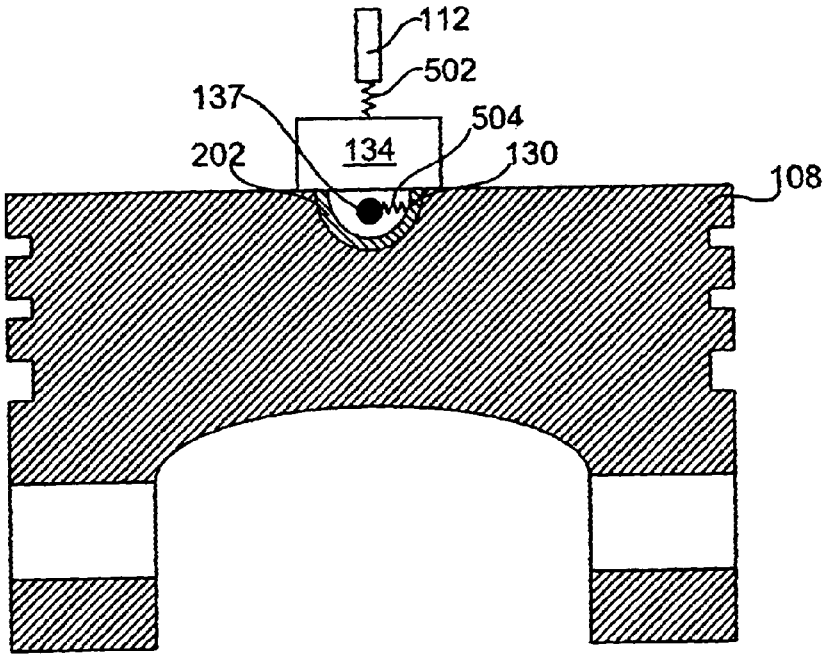
FIG. 5 is a cross-sectional view of the piston of FIG. 2 taken along line B—B.

FIG. 5 is a cross-sectional view of piston 108 taken along section line B—B at the time and position that voltage is supplied to power plug 112. Body 134 is a predetermined distance (spark gap) from power plug 112. As indicated above, body 134 is electrically coupled to exposed tip 137 of spark lead 136. When voltage is applied to power plug 112, a first electrical arc 502 is generated between power plug 112 and body 134, and a second electrical arc 504 is generated between exposed tip 137 of spark lead 136 and arc surface 130 (the inner surface of copper arc insert 202).

Figure 6:
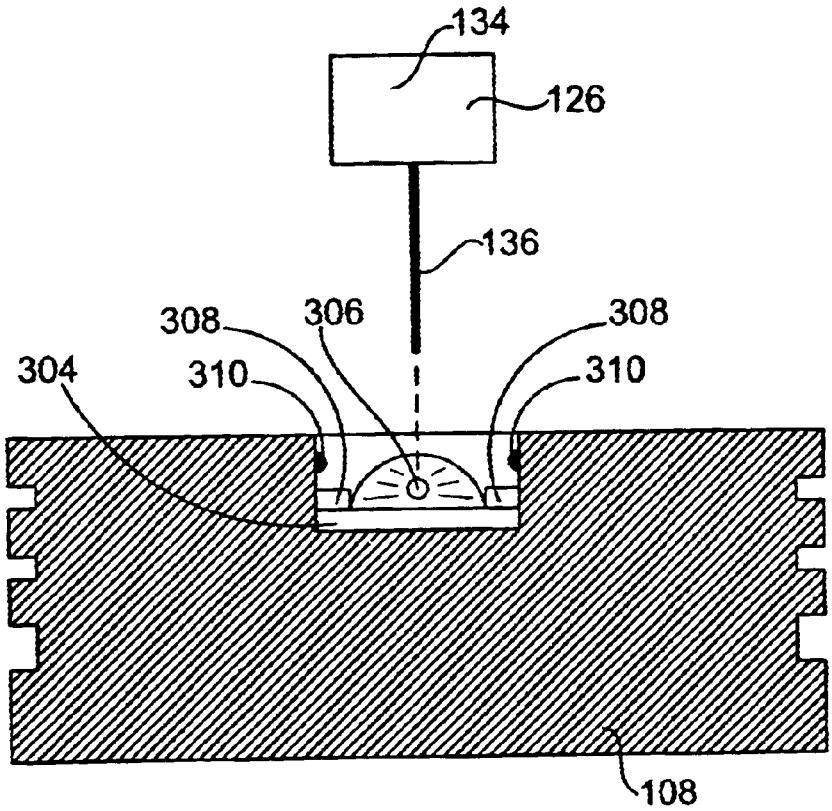
FIG. 6 is a cross-sectional view of the piston of FIG. 2 taken along line C—C.

FIG. 6 is a cross-sectional view of piston 108 taken along section line C—C, looking into the receiving end of insulating guide 128. Electrode 126 is positioned for insertion into insulating guide 128. Channel 306 of insulating guide 128 is tapered to guide spark lead 136 into channel 306. Each of positioning surfaces 308 positions body 126 in seat 304 so that spark lead 136 is inserted the proper distance into channel 306. Body 126 is sufficiently flexible to be pressed passed each of retaining structures 310 into a retained position.

Figure 7:
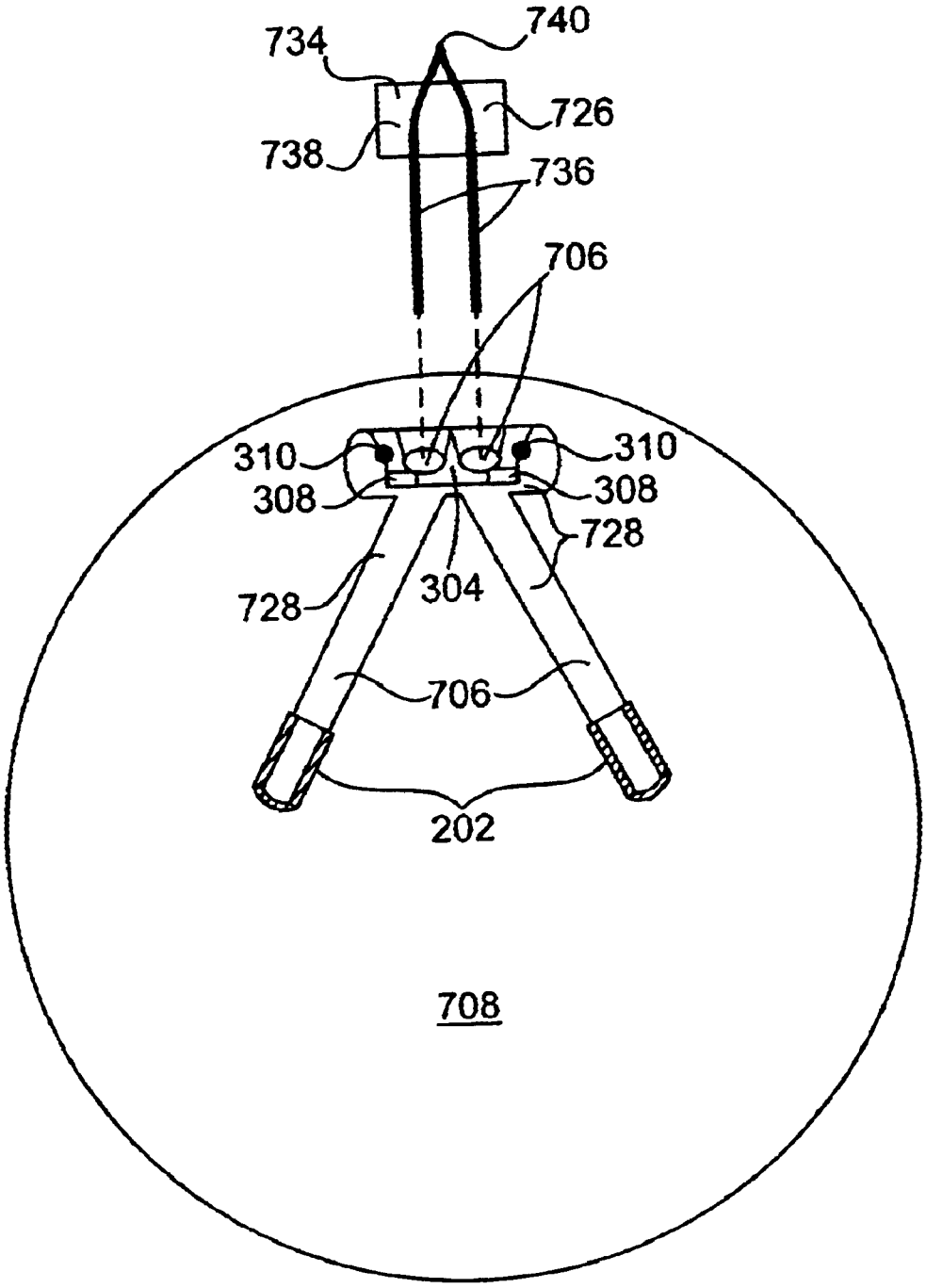
FIG. 7 is a top view of an alternate piston according to the present invention.

FIG. 7 is a top view of a piston 708 showing an alternate embodiment of the present invention. Piston 708 includes an electrode 726, an insulating guide 728, and a pair of arc inserts 202. Electrode 726 includes a body 734 and two spark leads 136, and is adapted to be inserted into insulating guide 728. Body 734 includes an insulated portion 738 and a conductive portion 740. Conductive portion 740 of body 726 is electrically coupled to each of spark leads 736. Optionally, spark leads 736 and conductive portion 740 of body 734 are formed from a single piece of conductor, mounted to insulating portion 738 of body 734.

Insulating guide 728 comprises a seat 304, two channels 706, two arc inserts 202, positioning surfaces 308, and retaining structures 310. Each of channels 706 is tapered at the receiving end of insulating guide 728 to easily receive a corresponding one of spark leads 736. After insertion, each of spark leads 736 are located a predetermined distance from a respective arc insert 202. Electrode 726 is properly positioned in seat 304 by abutting body 738 against positioning surfaces 308, and is pressed passed and retained by retaining structures 310. Spark leads 736 are coupled to the front face of body 726 so that when electrode 726 is in its retained position, each of spark leads 736 is generally aligned with its respective channel 306.

Supplying electric power to power plug 112 (not shown) causes a first electrical arc between power plug 112 and conductive portion 740, and a second electrical arc between the tip of each of spark leads 736 and a respective one of arc inserts 202. In this particular embodiment, three sparks are generated and would ignite a compressed air-fuel mixture in three spaced apart places within the combustion chamber, causing the air-fuel mixture to bum much quicker than in a conventional internal combustion engine having only a conventional spark plug.

Figure 8:
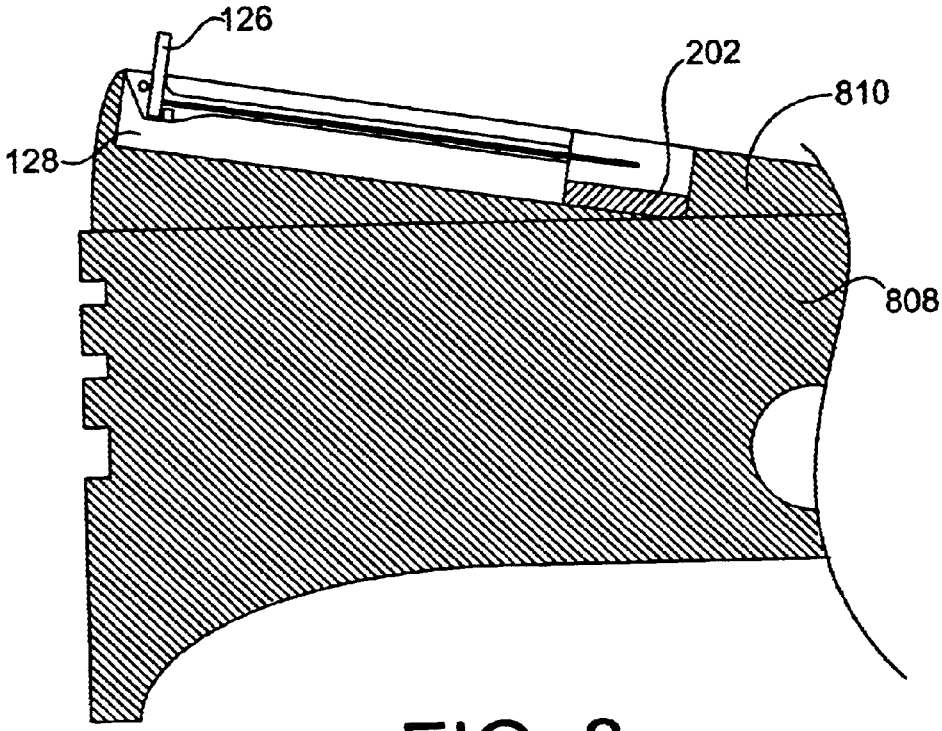
FIG. 8 is a cross-sectional view of another alternate piston according to the present invention.

FIG. 8 shows a domed-top piston 808 as another alternate embodiment of the present invention. Piston 808 includes domed portion 810. Insulating guide 128 and arc insert 202 are formed in dome portion 810. Electrode 126 is positioned in insulating guide 128 in the same manner described in the previous embodiments. Electrode 126 is optionally removable through power plug opening 122 (not shown).

Domed-top piston 808 is used primarily in racing applications that require high compression ratios and high-octane fuel. The present invention facilitates accelerated combustion of the high-octane fuel, increasing horsepower and torque. Further, in certain racing applications there is a potential for electrode 126 to be permanently formed in the insulating guide 128 of piston 808, due to the fact that racing engines are frequently disassembled and rebuilt.

The description of particular embodiments of the present invention is now complete. Many of the described features may be substituted, altered or omitted without departing from the scope of the invention. For example, alternate arc inserts (e.g., platinum inserts), may be substituted for the copper inserts disclosed, or the use of arc inserts may be omitted altogether. As another example, insulating guides may be preformed and fixed to the top of a piston, as opposed to being formed in (or just under) the surface of the piston. These and other deviations from the particular embodiments shown will be apparent to those skilled in the art, particularly in view of the foregoing disclosure.

I claim:

1. An internal combustion engine comprising:

a piston; and an insulating guide formed in said piston for receiving an electrode, said guide facilitating the selective removal of said electrode from said guide, and the reinsertion of a replacement electrode in said guide.

2. An internal combustion engine according to claim 1, further comprising an electrode disposed in said insulating guide.

3. An internal combustion engine according to claim 2, wherein said electrode is removable through an opening in said engine.

4. An internal combustion engine according to claim 3, wherein said electrode is flexible.

5. An internal combustion engine according to claim 2, further comprising a power plug disposed in a power plug opening of said internal combustion engine to transmit electrical current to said electrode, and wherein said electrode is removable through said power plug opening.

6. An internal combustion engine according to claim 2, wherein said electrode comprises a body and at least one spark lead coupled to said body.

7. An internal combustion engine according to claim 6, wherein said body is positioned with respect to said power plug such that providing electrical power to said power plug causes a first electrical arc between said power plug and said body and a second electrical arc between a tip of said spark lead and said piston at a predetermined time of engine operation.

8. An internal combustion engine according to claim 7, wherein said piston further comprises an arc insert disposed between said tip of said spark lead and said piston.

9. An internal combustion engine according to claim 8, wherein said arc insert comprises a piece of copper fixed to said piston.

10. An internal combustion engine according to claim 1, wherein said insulating guide comprises a plurality of channels, each for receiving one of a plurality of spark leads of said electrode.

11. An internal combustion engine according to claim 1, wherein said insulating guide is shaped to position said electrode within a predetermined distance from an arc surface adjacent an end of said insulating guide.

12. An internal combustion engine according to claim 1, wherein said insulating guide comprises a ceramic material.

13. An internal combustion engine according to claim 1, wherein said insulating guide is formed in a channel in a top surface of said piston.

14. An internal combustion engine according to claim 1, wherein said insulating guide comprises a hollow tube.

15. A piston, comprising:

a piston head; and an insulating guide formed in said piston head to recieve an electrode, said insulating guide facilitating the removal of said electrode from said guide and the replacement of said electrode.

16. A piston according to claim 15, further comprising:

an electrode adapted to mount within said insulating guide; and at least one arc surface to facilitate electrical arcing between said electrode and said arc surface.

17. A piston according to claim 16, wherein said electrode is slidably removable.

18. A piston according to claim 17, wherein said electrode is flexible.

19. A piston according to claim 18, wherein said insulating guide is tapered at a receiving end to facilitate easy insertion of said electrode in said insulating guide.

20. A piston according to claim 16, wherein said electrode comprises a body and at least one spark lead coupled to said body.

21. A piston according to claim 20, wherein:

said electrode includes a body and a plurality of spark leads coupled to said body; and said insulating guide includes a seat for receiving said body, and a plurality of channels each for receiving a respective one of said spark leads.

22. A piston according to claim 20, wherein said insulating guide positions a tip of said spark lead within a predetermined distance of said arc surface.

23. A piston according to claim 22, wherein said arc surface comprises a copper insert disposed in said piston.

24. A piston according to claim 22, wherein said arc surface comprises an arc insert mounted to said piston.

25. A piston according to claim 15, wherein said insulating guide comprises a ceramic material.

26. A piston according to claim 25, wherein said insulating guide is formed in a channel in a top surface of said piston.

27. An internal combustion engine according to claim 15, wherein said insulating guide comprises a hollow tube.

28. An electrode, comprising:

a body adapted to engage a piston; and at least one spark lead coupled to said body and adapted to feed through an insulating guide formed in said piston, whereby electrical current applied to said spark lead results in an arc between a tip of said spark lead and said piston.

29. An electrode according to claim 28, wherein at least a portion of said body is electrically conductive to transmit said electrical current to said spark lead.

30. An electrode according to claim 28, wherein said body is adapted to detachably engage said piston.

31. An electrode according to claim 28, wherein said electrode is flexible.

32. An electrode according to claim 31, further including a plurality of spark leads.

33. An electrode according to claim 32, wherein said body includes:

an insulating portion for engaging said piston; and a conductive portion for transmitting electrical power to said spark leads.

34. An internal combustion engine, comprising:

a piston; and insulating means formed in said piston for receiving an electrode.

35. An internal combustion engine according to claim 34, further comprising a spark means disposed in said insulating means for conducting electrical current to generate a spark.

36. An internal combustion engine according to claim 35, further comprising a plug means for supplying electrical current to said spark means.

37. An internal combustion engine according to claim 35, further comprising a removal means for removing said spark means from said internal combustion engine.

* * * * *